US005377609A

United States Patent [19]

Miller

[11] Patent Number: 5,377,609

[45] Date of Patent: Jan. 3, 1995

[54] HANDLE POLE WITH INTEGRAL GAS SPRING FOR JET SKIS

[76] Inventor: Edward W. Miller, 20022 Daniel La., Orange, Calif. 92669

[21] Appl. No.: 64,986

[22] Filed: May 24, 1993

[51] Int. Cl.[6] ..... B63H 25/00

[52] U.S. Cl. ..... 114/144 R; 114/270

[58] Field of Search ..... 114/270, 144 R; 267/120–123; 16/111 A; 74/480 B, 493; 440/38, 113; 296/58, 76; 49/386

[56] References Cited

U.S. PATENT DOCUMENTS

| | | | |
|---|---|---|---|
| 4,973,097 | 11/1990 | Hosan et al. | 262/120 |
| 4,989,532 | 2/1991 | Kishi et al. | 114/144 R |
| 5,067,277 | 11/1991 | Magalotti | 49/386 |
| 5,103,754 | 4/1992 | Fujitsubo | 114/270 |

FOREIGN PATENT DOCUMENTS

| | | | |
|---|---|---|---|
| 0169388 | 6/1990 | Japan | 114/144 R |
| 0086698 | 4/1991 | Japan | 114/144 R |
| 0176295 | 7/1991 | Japan | 114/144 R |

*Primary Examiner*—Edwin L. Swinehart
*Attorney, Agent, or Firm*—William L. Chapin

[57] ABSTRACT

A pivotable handle pole assembly for jet skis has integral gas spring for exerting a resilient upward bias force on the free end of the handle containing controls for the jet ski, thereby decreasing the apparent weight of the free end of the handle. The handle pole assembly includes a laterally elongated rectangular transverse cross-section beam pivotably mounted at the front end thereof between a pair of laterally spaced apart, longitudinally disposed flange plates forming side walls of a mounting frame having a flat base adapted to be attached to the body of a jet ski. A longitudinally disposed groove in the lower wall of the beam located between a vertical midplane and a side wall of the beam runs rearward from the front portion of the beam. An elongated linear gas spring within the groove has one end thereof pivotably fastened between opposite longitudinal groove walls, near the rear transverse wall of the groove. A piston rod protruding outwardly from the gas spring cylinder has an outer end pivotably fastened to the inner surface of an adjacent frame side wall. Gas pressure within the spring resiliently biases the beam of the handle pole assembly to an upward position.

15 Claims, 4 Drawing Sheets 10
11
12
13
14
15
16
17
18
19
20
23

HANDLE POLE WITH INTEGRAL GAS SPRING FOR JET SKIS

BACKGROUND OF THE INVENTION

A. Field of the Invention

The present invention relates to watercraft, specifically small boats called jet skis that are adapted to hold a single rider and which are powered by a gasoline engine-driven jet pump. More particularly, the invention relates to an improved handle pole construction for jet skis.

B. Description of Background Art

Small personal watercraft adapted to hold a single person and referred to as "jet skis" are becoming increasingly popular. Most jet skis are powered by a gasoline engine-driven pump that provides a rearward directed stream or jet of water to propel the craft. Usually, the output nozzle of the pump is pivotably mounted to the underside of the rear portion of the hull in a manner permitting horizontal motion of the rear opening of the nozzle, thereby allowing the thrust vector of the jet to be pivoted in a desired direction to steer the craft Jet skis are typically piloted by an operator standing or kneeling on the aft portion of the craft. Usually, a flat, padded platform or tray is provided for the operator to stand or kneel on.

In most jet skis, steering and engine controls are mounted on the aft end of a handle pole that is located ahead of the platform. Typically, the steering control consists of a pair of handlebars that protrude laterally outwards from the aft end of the handle pole. The handlebars are pivotable with respect to the longitudinal axis of the handle pole and are connected to a shaft which is mechanically coupled to the jet nozzle, usually by means of cables.

Most handle poles are pivotably mounted to the forward portion of the hull, in a manner permitting vertical pivotal motion of the aft end of the handle pole on which the handlebars and engine throttle controls are located. Thus, most handle poles are pivotably mounted at the front end of the handle pole to provide vertical pivotability of the handle pole. The reason for providing vertical pivotability for the handle pole of the jet ski is to permit the handlebars to be positioned at various heights above the operator's platform. For example, when the operator is in a kneeling position on the platform the handle pole would typically be pivoted downward to its lowest position. Conversely, with the operator standing on the platform, the handle pole would usually be pivoted upwards to a position intermediate its lower and upper travel limits.

During vigorous operation of a jet ski, especially on rough water, the craft may experience rather substantial pitching, and/or vertical translational motions. During such motions, experienced jet ski operators assume a partially crouched position, using their knee joints as shock absorbers while the handle pole which is gripped by the operator is maintained at a relatively constant height above the platform, by cooperative pivotal action of the arms. While this stance aids the operator in maintaining a firm grip on the handlebars during vigorous maneuvers, supporting the weight of the aft end of the handle pole can tire the arms. For this reason, a variety of mechanisms have been proposed to counterbalance or counteract the downward force exerted by the aft end of the handle pole on the arms of an operator gripping the handlebars. For example, U.S. Pat. No. 4,733,627, Mar. 29, 1988, Nishida discloses a resistance mechanism connected between the control handle and hull of a boat. The resistance mechanism includes an air cylinder having a piston which is biased to a contracted position by means of a helical extension spring within the cylinder. A bypass pipe allows the piston to displace air freely for a fixed stroke length until the piston reaches a port of the bypass pipe, and consequently there is almost no resistance (except that of the spring) when the handle is moved from a horizontal position to a central position at which point the piston closes the port. If the handle is moved further from the central position, air trapped inside the cylinder is compressed as the piston moves, creating a resistance to movement. The handle can be set to a specific position by moving it to that position and manually opening and then reclosing a valve mounted in a second bypass tube connected to opposite end walls of cylinder. A second means for resisting handle pivoting disclosed in Nishida includes a coiled torsion spring wrapped around the handle's pivot shaft and attached to the hull and handle. A third means disclosed in Nishida consists of an elastic section positioned between a stop attached to the hull and a cam formed on the outer surface of the handle.

In U.S. Pat. No. 5,103,754, Apr. 14, 1992, Fujitsubo, a shock absorber for jet ski handles is disclosed which is used with a handle bar biased upwards by a coil spring. The shock absorber, which is mounted externally to the handle, comprises a cylinder-and-piston assembly, the cylinder and piston of which are pivotably attached to a water jet ski body and to the handlebar of the water jet ski respectively. The fluid filled in the cylinder is allowed to pass through the orifices of the piston body while the piston moves back and forward in the cylinder in response to the rise and descent of the handlebar. With this arrangement the rider can move the handlebar up and down freely so as to permit him to keep his balance on the water jet ski while running on water. The orifice size is selected to be appropriate for the purpose of preventing uncontrollable quick move of the handlebar which otherwise would be caused by sudden application of a strong force to the water jet ski body, thereby preventing the rider from losing his balance on the water jet ski.

U.S. Pat. No. 5,113,777, May 19, 1992, Kobayashi, discloses a steering device for jet boats in which an air strut is interposed between the ski assembly and the hull so as to provide controlled movement of the ski vertically relative to the steering shaft. The strut has a pivotal connection to a boss at the forward portion of the ski and a pivotal connection to the upper bracket for the steering shaft.

No prior art devices known to the present inventor, including those discussed above, provide means for limiting the downward force exerted on the arms of a let ski operator by the handle pole, that do not have certain drawbacks. For example, the fluid cylinders in Nishida and Fujitsubo are external to the handle pole. The external location of the cylinders detracts from the aesthetic appearance of the jet skis to which the cylinders are attached. Moreover, the space between the hull, handle and external cylinder provides a possibly dangerous trap for the arms or legs of an operator boarding or unboarding the craft.

In view of perceived limitations of prior art approaches to providing a support mechanism for jet ski handle poles that is both functional and comfortable for the operator to use, the improved handle pole construction according to the present invention was conceived of.

OBJECTS OF THE INVENTION

An object of the present invention is to provide a handle pole assembly for personal watercraft such as jet skis which incorporates integral means for resisting the static downward force exerted by the free end of the handle pole, thereby limiting the perceived weight of that end of the handle pole.

Another object of the invention is to provide a pivotable handle pole assembly for jet skis that includes means internal to the handle pole for limiting the apparent weight of the free end of the handle.

Another object of the invention is to provide a pivotable handle pole assembly for jet skis that includes downward force-reducing means that are not fastened to the hull of the jet ski.

Another object of the invention is to provide a pivotable handle pole assembly for jet skis that incorporates an internal gas spring to limit apparent weight of the handlebar end of the handle pole assembly.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends an improved handle pole assembly for jet skis.

The improved handle pole assembly for jet skis according to the present invention includes a mounting frame having a flat, rectangular base adapted to be bolted to the upper surface of the hull of a jet ski. The mounting frame includes a pair of parallel vertically disposed side walls that protrude perpendicularly upwards from opposite longitudinal sides of the base.

A pair of laterally aligned holes in the two side walls rotatably support a laterally disposed pivot pin above the base. The pivot pin protrudes laterally through the front portion of the side walls of an elongated hollow handle pole having a generally rectangular transverse cross-sectional shape. Formed in the bottom wall of the handle pole is a relatively deep longitudinally elongated, rectangular cross-section groove or depression. The groove is located near a vertically disposed side wall of the handle pole, and extends rearward from a location near the pivot pin.

Near the rear transverse end wall of the groove, a transversely disposed pin fastened to opposite side walls of the groove pivotably supports the cylinder of a gas spring. The piston rod of the gas spring, which protrudes forward at the limit of its travel with the handle pole on its uppermost pivotal position, has in its forward end a socket. The socket is rotatably secured to a ball screw which protrudes laterally inwards from an adjacent side wall of the mounting frame. The axis of the ball screw is located below and rearward of the handle pole pivot pin, and is so positioned as to confine the gas spring substantially within the groove in the bottom wall of the handle pole, even when the gas spring is pivoted outwards the maximum distance from the upper wall of the groove, with the handle pole in its fully upright position. Gas pressure within the gas spring exerts an extensional force on the gas spring piston, producing an upward torque on the handle pole that opposes the downward torque produced by the weight of the handlebars, handle pole and controls rearward of the pivot axis. Thus constructed, the handlebar end of the handle pole exerts substantially less downward force on the arms of an operator when the handle pole is lifted upwards from its lowermost position, thereby greatly reducing fatigue loads on the arms of the operator.

DETAILED DESCRIPTION OF THE INVENTION

Referring now to FIGS. 1 through 12, a novel jet ski handle assembly according to the present invention is shown attached to a jet ski.

Figures 1, 2, 3:
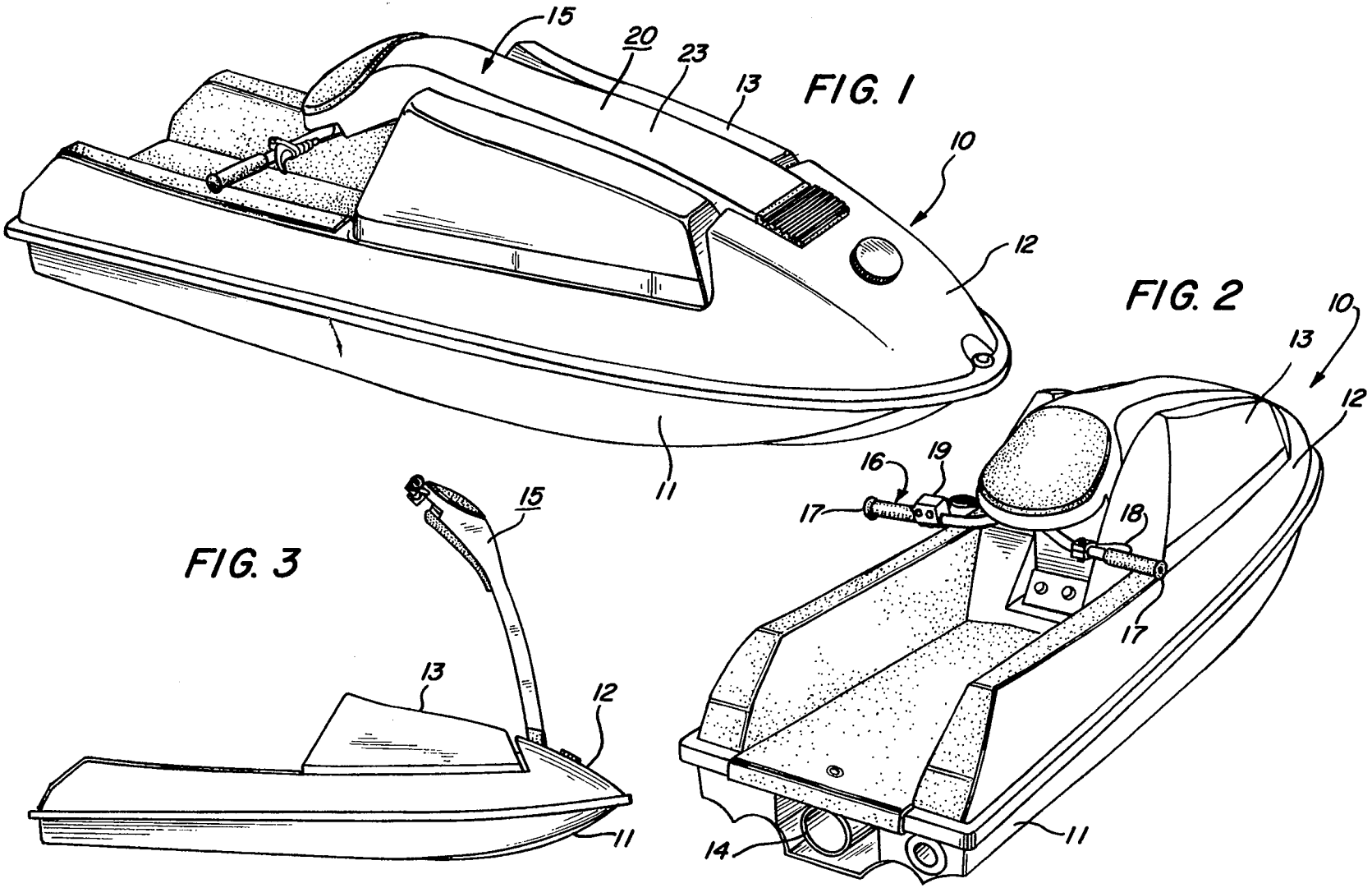
FIG. 1 is a front perspective view of a jet ski having a handle pole with an integral gas spring according to the present invention.
FIG. 2 is a rear perspective view of the jet ski of FIG. 1.
FIG. 3 is a side elevation view of the jet ski of FIG. 1, with the handle pole pivoted upwards to its uppermost position.

As shown in FIGS. 1 and 2, a jet ski 10 includes a hull 11 and an overlying superstructure 12. Superstructure 12 includes an engine compartment covered by a hood assembly 13. An engine (not shown) concealed by hood assembly 13 is coupled to a jet pump (not shown) having a rearward directed, horizontally pivotable nozzle 14.

As shown in FIGS. 1 through 3, jet ski 10 includes a handle pole assembly 15 pivotably mounted at its forward end to superstructure 12. Handle pole assembly 15 includes a handlebar assembly 16 mounted to the aft end of the handle pole assembly. Handlebar assembly 16 includes a pair of laterally outwardly protruding handlebars 17 Handlebar assembly 16 is pivotable with respect to the longitudinally axis of handle pole assembly 15. A mechanical coupling system (not shown) between handlebar assembly 16 and jet nozzle 14 allows the nozzle to be pivoted in response to pivotal movement of the handlebars relative to handle pole assembly 15, thereby allowing the thrust vector of the jet nozzle, and therefore, the travel direction of the jet ski, to be steered. As may be seen best by referring to FIG. 2, handlebar assembly 17 includes an engine throttle control lever 18 attached to one handlebar 17, and an engine start/kill switch assembly 19 fastened to the other handlebar.

Figures 4, 5, 7, 8:
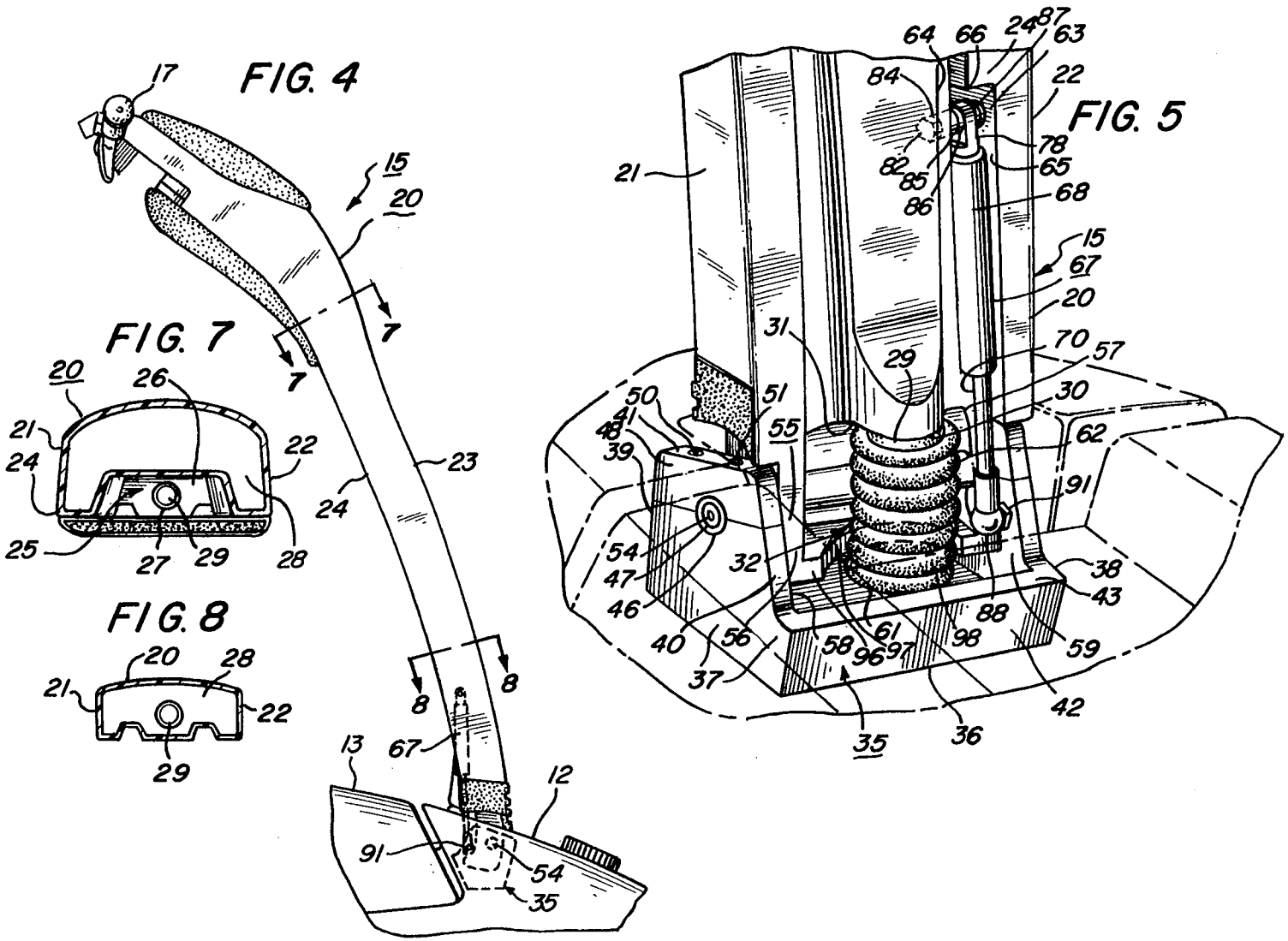
FIG. 4 is a fragmentary side elevation view of the jet ski of FIG. 3, showing the handle pole assembly on a somewhat enlarged scale relative to that of FIG. 3.
FIG. 5 is a broken rear perspective view of the handle pole assembly of FIG. 4, on a scale enlarged relative to that of FIG. 4.
FIG. 7 is a sectional view of the handle pole assembly of FIG. 5, taken along line 7—7.
FIG. 8 is a sectional view of the handle pole assembly of FIG. 5, taken along line 8—8.

As may be seen best by referring to FIGS. 3 through 8, handle pole assembly 15 includes an elongated hollow beam 20 that has a generally rectangular transverse cross-sectional shape. Beam 20 has vertically disposed left and right side walls 21 and 22, respectively. As may be seen best by referring to FIGS. 1 and 3, beam 20 of handle pole assembly 15 has a generally horizontally disposed upper wall 23. However, as is shown in FIG. 4, beam 20 has in side elevation view a slightly arcuate shape, so that in that view, upper wall 23 of the beam is slightly convex, while lower wall 24 of the beam is slightly concave.

As may be seen best by referring to FIGS. 7 and 8, beam 20 is hollow, and has a laterally elongated, generally rectangular transverse cross-sectional shape. As may be seen best by referring to FIGS. 7 and 6, a short, relatively deep rectangular cross-section depression 25 is formed in the lower wall 24 of beam 20, near the aft end of the beam. Depression 25 varies longitudinally in depth, being relatively more shallow at the aft end thereof, and relatively deep at the forward end thereof. The forward end of depression 25 is bounded by a downwardly angled, transversely disposed bulkhead 26. As shown in FIG. 7 bulkhead 26 has a circular through-hole 27 that communicates with the hollow interior space 28 of beam 20. An elongated cylindrically-shaped flexible tube 29 protrudes rearward through hole 27, and runs longitudinally through interior space 28 of beam 20. As may be seen best by referring to FIG. 5, tube 29 protrudes forward through a hole 30 formed in a bulkhead 31 forming the rear wall of a front recessed area 32 formed in lower wall 29 of beam 20, near the front end of the beam. The function of tube 29 is to contain steering cables, engine throttle control cable, and electrical wiring running from controls on handlebars 17 to jet nozzle 14 and a battery and gasoline engine (neither shown) concealed beneath engine hood assembly 13.

Referring now to FIGS. 4 through 6 and 9 through 12, handle pole assembly 15 may be seen to include a mounting frame 35 fastened to hull 11 of jet ski 10, the mounting frame pivotably supporting beam 20 of the handle pole assembly. As may be seen best by referring to FIGS. 4 through 6, 8 and 11, mounting frame 35 has in overall appearance the shape of an open box having a rectangular base 36 and parallel left and right side walls 37 and 38 protruding perpendicularly upwards from opposite longitudinal edges of the base. Side walls 37 and 38, which are identically shaped, have in side elevation view the shape of a quadrilateral with straight front and rear edge walls 39 and 40, respectively, angled forward with respect to the rear portion of base 36. Each side wall 37 and 38 also has a straight upper edge wall 41 that is angled downward from rear edge wall 40 of the side wall to its front edge wall 39.

Figure 6:
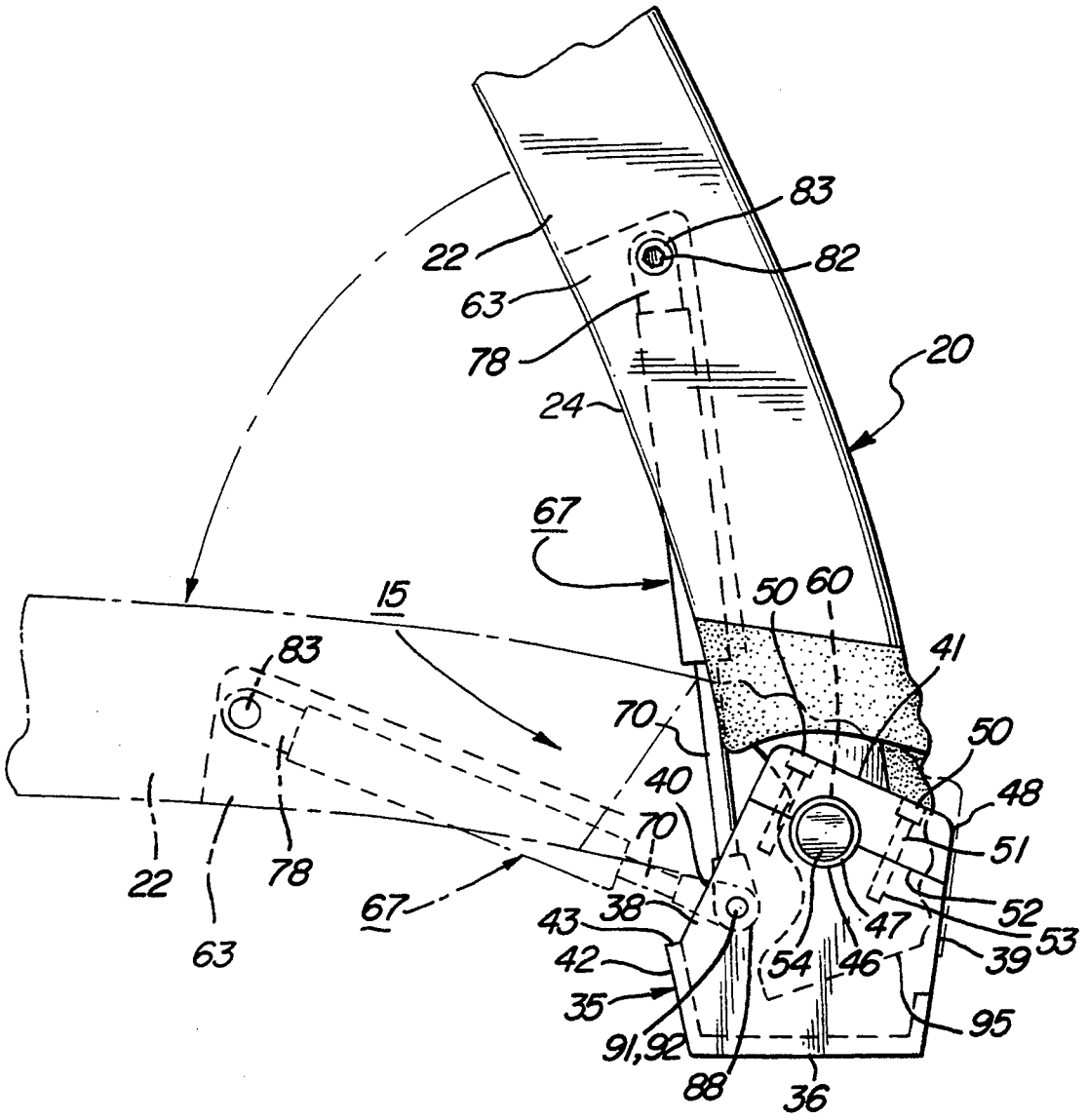
FIG. 6 is a fragmentary side elevation view of the structure of FIG. 5.
Figure 9:
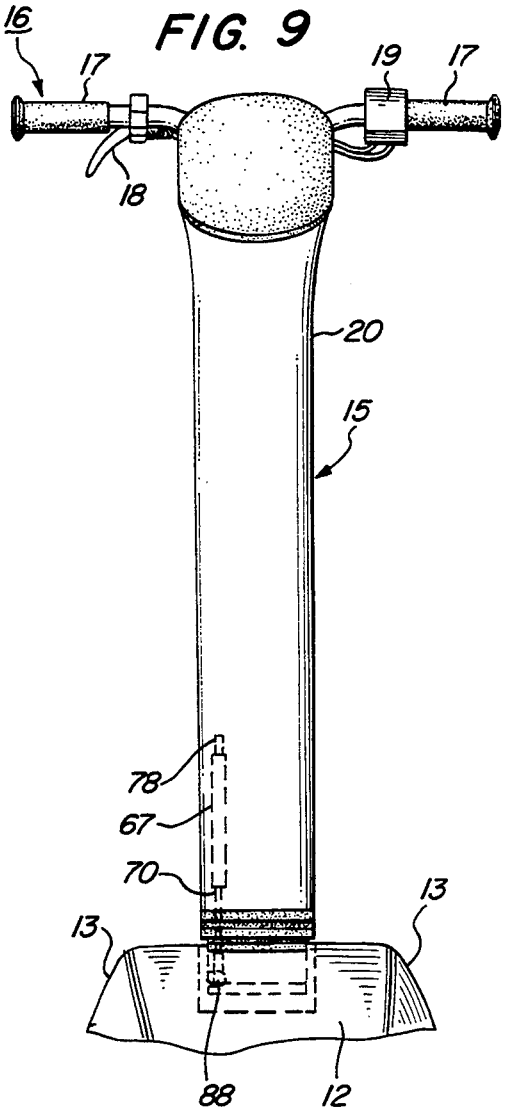
FIG. 9 is a fragmentary front elevation view of the handle pole assembly of FIG. 5, with the handle pole in a fully upright position.

As may be seen best by referring to FIGS. 5 and 6, mounting frame 35 includes a rear laterally elongated, generally rectangularly-shaped rear wall 42 that protrudes upwards from the rear edge of base 36. Rear wall 42 has a bottom face contiguous with base 36, and left and right outer faces contiguous with the outer faces of left and right side walls 37 and 38, respectively. Rear wall 42 is relatively short, the height of its upper laterally disposed straight edge wall 43 being substantially less than the maximum height of left and right side walls 37 and 38.

Figure 10:
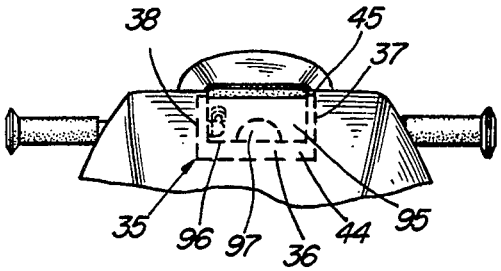
FIG. 10 is a fragmentary front elevation view of the handle pole assembly of FIG. 9, with the handle pole in a fully lowered position.

As shown in FIG. 10, mounting frame 35 includes a laterally elongated, generally rectangularly-shaped front wall 44 that protrudes upwards from the front edge of base 36. Front wall 44 has a bottom face contiguous with base 36, and left and right outer faces contiguous with the outer faces of left and right side walls 37 and 38, respectively. Front wall 44 has an upper laterally disposed edge wall 45 that is parallel to base 36, and is relatively shorter than rear wall 42. Mounting frame 35 is preferably a metal casting, but may be fabricated from steel plates as a weldment, or by similar means.

As may be seen best by referring to FIGS. 5 and 6, side walls 37 and 38 are each provided with a through-hole 46 located in the upper portion of the side wall, the two holes being axially aligned. Holes 46 in left and right side walls 37 and 38 are both press-fitted with a sleeve bearing 47. Preferably as shown in FIGS. 5 and 6, the upper portion of each side wall 37 and 38 is segmented into portions along a parting line that bisects through-hole 46. In this construction, each side wall 37 and 38 has a removable upper bearing block member 48 having a generally rectangular shape. Upper bearing block 48 of each side wall 37 or 38 is secured to the lower portion 49 of the side wall by means of screws 50 inserted into a pair of through-holes 51 that extend from the upper edge wall 41 of upper bearing block member 48 of side walls 37 and 38, through lower edge wall 52 of the upper bearing block member. Screws 50 threadingly engage threaded blind holes 53 that extend downwards from the upper edge wall 54 of lower portion 49 of side walls 37 and 38. With side walls 37 and 38 constructed in two pieces as described above, sleeve bearing 47 may more easily be installed and replaced within through-holes 46 in the side walls.

Referring now to FIGS. 4 through 6 and 10, it may be seen that the forward end of beam 20 of handle pole assembly 15 is pivotably supported by a pivot pin 54 rotatably supported in sleeve bearing 47 in opposite side walls 37 and 38. As may be seen best by referring to FIG. 5, beam 20 has a short front portion, designated generally by the numeral 55, of less width than the remainder of the beam. Thus, front portion 55 of beam 20 has left and right side walls 56 and 57 that are parallel and spaced laterally inwards of the left and right side walls 21 and 22 of the main body of beam 20.

Figure 11:
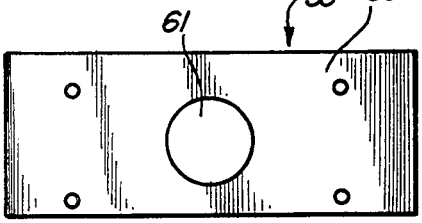
FIG. 11 is a bottom plan view of a mounting frame comprising part of the apparatus of FIG. 6.

The width of front section 55 of beam 20 is of the proper size to position left and right outer side walls 56 and 57 of the front section close to left and right inner side walls 58 and 59 of frame side walls 37 and 38, respectively. Pivot pin 54, which is rotatably supported in frame side walls 37 and 38, passes through a laterally disposed hole 60 that extends through side walls 56 and 57 of front section 55 of beam 20, and is secured to the front section of the beam. This arrangement permits free pivotability in a vertical plane of beam 20 of handle assembly 15, with respect to mounting frame 35. As shown in FIG. 11, base 36 of mounting frame 35 is provided with a centrally located hole 61 through the thickness dimension of the base. As shown in FIG. 5, the purpose of hole 61 is to provide a passageway into superstructure 12 of jet ski 10 for cables and electrical wiring (not shown) running through beam 20 of handle pole assembly 15 and exiting from hole 30 in front bulkhead 31 of beam 20. Preferably, as shown in FIG. 5, a flexible elastomeric tube 62 having an annularly convoluted cylindrical wall surface runs between hole 61 and hole 30. Thus constructed, tube 62 is adapted to resiliently contract axially when handle pole assembly 15 is pivoted downward towards frame base 36 from the position shown in FIG. 5, to the position shown in FIGS. 1 and 10.

Referring now to FIG. 5, the novel means according to the present invention for counterbalancing the weight of the handlebar end of beam 20 will now be described. As shown in FIG. 5, an elongated longitudinally disposed groove 63 is formed in lower wall 24 of beam 20. Groove 63 is located adjacent right outer side wall 22 of beam 20, and extends rearward from recessed area 32 formed in lower wall 24 of front portion 55 of the beam. Groove 63 has a generally U-shaped transverse cross section, tapering from a relatively deep rear section to a relatively shallow front opening communicating with recessed area 32 of beam 20. As shown in FIG. 5, groove 63 has parallel inner and outer longitudinally disposed walls 64 and 65, respectively, terminating in a rear transverse wall 66. The function of groove 63 is to contain the cylinder of a gas spring 67.

Figure 12:
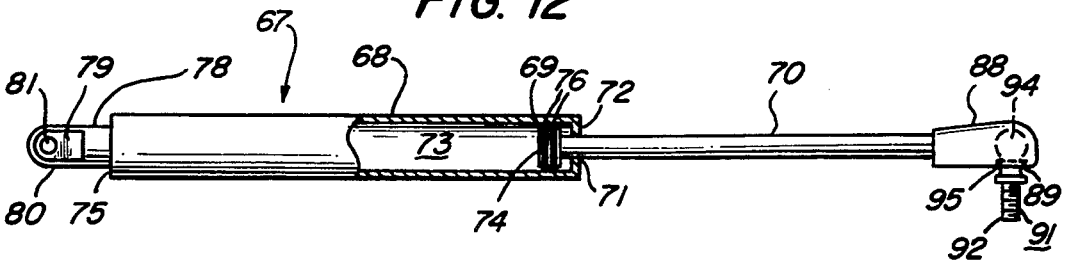
FIG. 12 is a longitudinal sectional view of a gas spring used in the handle pole assembly of FIG. 4.

As shown in FIG. 12, gas spring 67 includes an external sealed cylinder 68 slidably containing a piston 69 having a piston rod 70 that protrudes axially outward through a central coaxial opening 71 in a circular end plate 72 sealing one end of the cylinder. The cylindrical space 73 between the rear circular surface 74 of piston 69 and rear circular end plate 75 of cylinder 68 is filled with gas at a relatively high pressure. Piston rings 76 form a gas-tight seal with the inner cylindrical wall surface 77 of cylinder 68. Thus, the gas within cylindrical space 73 of piston 69 exerts a substantial extensional force on piston 69, causing piston rod 70 to be forced outwards from cylinder 68. When piston rod 70 is pushed inwards into cylinder 68, the corresponding decrease in the volume of cylindrical space 73 causes a corresponding increase in the pressure of the gas within the space, which thereby proportionally increases the extensional reaction force exerted by piston rod 70. Thus, gas spring 67 functions as a straight compression spring, producing a longitudinally outwardly directed reaction force proportional to inward longitudinal displacement of piston rod 70.

Referring now to FIGS. 5 and 12, gas spring 67 may be seen to have a mounting lug 78 protruding axially rearward from cylinder 68. Mounting lug 78 has a generally cylindrical shape, modified by a pair of parallel longitudinally disposed flats 79 formed in diametrically opposed portions of the outer cylindrical wall surface 80 of the mounting lug 78. A hole 81 extends through flats 79. As shown in FIG. 6, a socket head screw 82 inserted through a countersunk through-hole 83 in right side wall 22 of beam 20 extends into groove 63 and through hole 81 in mounting lug 78. The end of screw 82 also penetrates a hole 84 in inner side wall 64 of groove 63, hole 84 being transversely aligned with hole 83. Screw 82 threadingly engages a nut 85 located adjacent inner side wall 64 of groove 63. A flat washer 86 between nut 85 and inner flat 79 of cylinder mounting lug 78, in conjunction with a cylindrical spacer bushing 87 located between outer flat 79 of the mounting lug and right side wall 22 of beam 20, allow pivotal motion of lug 78 around screw 82.

As shown in FIGS. 5, 6 and 12, the outer lateral end of piston rod 70 of gas spring 67 has attached thereto a socket 88 having an opening 89 facing the inner wall surface 90 of right side wall 38 of mounting frame 35. Socket 88 is rotatably secured to frame 35 by means of a ball screw 91 having a threaded stud portion 92 screwed into a threaded hole 93 in right side wall 38. Ball screw 91 has a ball 94 formed in the end of the ball screw opposite threaded stud portion 92. The diameter of ball 94 is slightly less than the inner diameter of socket 88, but larger than the diameter of opening 89 in an annular plate 95 secured to the flat right face 96 of socket 88. Thus, socket 88 is secured against translational motion with respect to ball screw 91, but free to rotate on ball 94. With this arrangement, the outward extensional force exerted by piston rod 70 of gas spring 67 spring biases beam 20 of handle pole assembly 15 to rotate upwards on pivot pin 54 to an upright position, as shown in FIGS. 3 through 6 and 9.

The upward torque or moment on beam 20 is given by the product of the instantaneous extensional force exerted by gas spring 67 times the instantaneous perpendicular distance between the normal force vector applied by the gas spring socket head screw 82 and pivot axis 54 of beam 20. This moment is chosen to be slightly less than the downward moment exerted around pivot axis 54 by the weight of beam 20 and the attachments to the beam including handle bar assembly 16. With this choice of moments, the apparent weight of handle pole beam 20 and attachments, as perceived by an operator lifting the handle bar assembly 16 and beam 20 from its lowermost position, as shown in FIGS. 1 and 2, to an intermediate position, or a fully upright position, as shown in FIGS. 3–6 and 9, is substantially less than the downward force that would be exerted on the arms of an operator lifting a handle pole not provided with gas spring 67. This effective weight reduction greatly reduces the tendency for an operator's arm muscles to experience fatigue during operation of jet ski 10, enhancing the enjoyment and safety of operating the craft.

FIG. 10 is a front view of handle pole assembly 15 in a fully lowered position. As shown in FIGS. 6 and 10, beam 20 of handle pole assembly 15 has a front laterally disposed flange section 95 that depends downwardly and slightly forward from upper wall 23 of the beam. Flange section 95 spans the width of front portion 55 of beam 20, and has transversely disposed lower edge wall 96. A relatively deep, substantially semicircularly-shaped notch 97 extends upward into lower edge wall 96 of flange section 95, the notch being symmetrical about a longitudinal mid-plane of the edge wall. As may be seen best by referring to FIG. 5, the function of notch 97 is to provide clearance for flexible tube 62 through which control cables and wiring run. Preferably, flange section 95 and front portion 55 of beam 20 are covered by a laterally convoluted, protective elastomeric boot 98.

Referring to FIG. 6, it may be seen that gas spring 67 is substantially confined in groove 63 in lower wall 24 of beam 20, with the beam in its fully upright position. As shown in FIG. 6, only a small portion of the lower front part of the gas cylinder protrudes downward out from the groove. Thus, there is no space between any elements of gas spring 67 and any other structural elements of handle pole assembly 15 that could possibly form a trap for the fingers, hands or legs of an operator. With beam 20 of handle pole assembly 15 in its lowermost position, as shown in phantom in FIG. 6, an even smaller portion of gas spring 67 protrudes from groove 63. It is important to note that in addition to providing a safe and effective means for reducing the apparent weight of a handle pole, handle pole assembly 15 according to the present invention is completely self-contained, having an integral gas spring. Therefore, the novel construction of the handle pole assembly according to the present invention is inherently rugged, the gas spring being attached directly to rugged components of the handle pole beam and mounting frame. This construction eliminates the requirement for providing additional attachment points on the hull or superstructure of the jet ski. Such additional points would typically be weaker than those integral to the handle pole assembly, and would detract from the appearance and utility of the jet ski.

What is claimed is:

1. A handle pole assembly for jet skis comprising;

a. an elongated handle pole having the shape of a rectangular transverse cross-section beam including a generally transversely disposed upper side wall, a lower side wall generally parallel to said upper side wall, and left and right side walls depending downwardly from said upper side wall, said beam having an aft end adapted to support controls for said jet ski, said beam having a short front portion of reduced width, said front portion having generally vertically disposed left and right side walls displaced laterally inwards from the adjacent side walls of said beam rearward of said front section, said lower wall of said beam having formed therein longitudinally elongated hollow tubular section extending rearward from said front section and adapted to receive control cables and a longitudinally disposed groove extending rearward from said front section of said beam, said groove being located between said hollow tubular section and one of said side walls of said beam, b. a mounting frame having a base adapted to be fastened to the body of a jet ski, and a pair of laterally spaced apart longitudinally disposed side walls protruding upwards from said base, the spacing between the inner facing side of said side walls begin of the proper size to sandwich said front section of said beam, each of said pair of side walls having a laterally disposed bore through the thickness dimension thereof, said bores being laterally aligned and adapted to support a laterally disposed pivot means adapted to permit pivotal motion in a vertical plane of said front section of said beam, and c. a linear gas spring having a first longitudinal end portion thereof attached to a second laterally disposed pivot member located within said groove in said lower wall surface of said beam near the rear transverse wall of said groove, and a second longitudinal end thereof attached to a third, laterally disposed pivot member attached to said mounting frame, said gas spring being adapted to exert an extensional force between said second and third pivot members tending to cause said beam and said gas spring to pivot upwards, thereby counterbalancing at least part of the weight of said aft end of said handle pole.

2. The handle pole assembly of claim 1 wherein said beam is further defined as having formed in the lower wall thereof an upwardly notched region communicating with the front portion of said longitudinally disposed groove.

3. The handle pole assembly of claim 2 wherein said first longitudinal end of said gas spring is further defined as being a mounting lug protruding longitudinally outwards from a first end of the external cylinder of said gas spring, said mounting lug being provided with a transversely disposed bore that receives a transversely disposed pivot pin attached to said beam.

4. The handle pole assembly of claim 3 wherein said second longitudinal end of said gas spring is further defined as being a socket attached to the outer end of the piston rod of said gas spring, said socket rotatably engaging a ball protruding laterally inwards from an adjacent side wall of said mounting frame.

5. The handle pole assembly of claim 2 wherein said notched region in said front portion of said lower wall of said beam is further defined as having a transversely disposed rear wall oriented generally perpendicularly to said upper wall of said beam, said rear wall having therethrough an aperture adapted to permit control cables within said beam to exit the interior of said beam.

6. The handle pole assembly of claim 5 wherein said base of said mounting frame is further defined as having therethrough a perforation adapted to permit passage of said control cables through said base into the body of said jet ski.

7. The handle pole assembly of claim 6 wherein said beam is further defined as having a transversely disposed front end wall that depends downwardly from said upper wall of said beam, said front end wall having formed in the lower edge wall thereof an upwardly protruding notch adapted to provide clearance for said control cables with said beam pivoted to an upward position.

8. A handle pole assembly for jet skis comprising;

a. an elongated handle pole having a forward end and an aft end, said handle pole having the shape of an elongated beam including a lower wall disposed generally transversely to the longitudinal axis of said handle pole, an upper wall disposed generally transversely to said longitudinal axis and left and right side walls joining said lower and upper walls, said beam having a hollow interior space containing a longitudinally elongated hollow tubular section located between one of said side walls, and adapted to receive control cables, said lower wall of said beam having formed therein an elongated longitudinally disposed groove located between and spaced apart from said hollow tubular section and one of said side walls of said beam, b. a mounting frame having first pivot means adapted to fasten to the body of a jet ski and pivotably support a forward end of said handle pole, and c. linear compression spring means fastened to said handle pole and said mounting frame in a manner producing a torque on said handle pole about the axis of said pivot means in a direction tending to resiliently bias said aft end of said handle pole to an upward direction, thereby decreasing the apparent weight of said aft end of said handle pole, said spring means being located in said elongated longitudinally disposed groove so as to form no transversely penetrably opening between said spring means and said handle pole or said mounting frame throughout the permitted pivotal excursion of said handle pole relative to said mounting frame.

9. The handle pole assembly of claim 8 wherein said linear compression spring means is further defined as having a first end thereof pivotably fastened within said groove to said handle pole by second pivot means.

10. The handle pole assembly of claim 9 wherein said linear compression spring means is further defined as having a second end thereof pivotably fastened to said mounting frame by third pivot means.

11. The handle pole assembly of claim 10 wherein said linear compression spring means is further defined as being a gas spring.

12. The handle pole assembly of claim 11 wherein said gas spring is further defined as having a pressurized cylinder slidably containing a piston to which is attached an axially outwardly protruding piston rod, said piston and rod being resiliently biased by gas pressure within said cylinder to an outwardly extending position.

13. The handle pole assembly of claim 8 wherein said third pivot means pivotably joining said second end of said gas spring to said mounting frame is further defined as being located rearward of said first pivot means pivotably supporting said front end of said handle pole.

14. The handle pole assembly of claim 8 wherein said third pivot means pivotably joining said second end of said gas spring to said mounting frame is further defined as being located below said first pivot means pivotably supporting said front end of said handle pole

15. The handle pole assembly of claim 8 wherein said third pivot means pivotably joining said second end of said gas spring to said mounting frame is further defined as protruding laterally inwards from an inner surface of one of said side walls of said mounting frame.

* * * * *